United States Patent [19]

Arnett et al.

[11] 4,278,968

[45] Jul. 14, 1981

[54] DOOR STATUS DETECTOR APPARATUS

[76] Inventors: Coleman C. Arnett, P.O. Box 1472, Lewisville, Tex. 75067; James W. Godfrey, 4613 NW. 61st, Oklahoma City, Okla. 73122; Mark R. Miller, P.O. Box 1375, Lewisville, Tex. 75067

[21] Appl. No.: 93,731

[22] Filed: Nov. 13, 1979

[51] Int. Cl.[3] ..... G08B 21/00

[52] U.S. Cl. ..... 340/545; 340/309.1

[58] Field of Search ..... 340/528, 546, 547, 309.1, 340/545

[56] References Cited

U.S. PATENT DOCUMENTS

| | | | |
|---|---|---|---|
| 3,771,154 | 11/1973 | Takei | 340/528 |
| 4,155,077 | 5/1979 | Rohan | 340/546 |
| 4,160,972 | 7/1979 | La Mell | 340/547 |

*Primary Examiner*—Harold I. Pitts

*Attorney, Agent, or Firm*—Laney, Dougherty, Hessin & Beavers

[57] ABSTRACT

An apparatus is disclosed which creates a signal that indicates when a door has remained open for a predetermined amount of time. The apparatus includes a switch element responsive to the opening of the door and the closing of the door for monitoring the positional status of the door. The apparatus further includes electrical circuit components responsive to the monitoring switch for detecting when the door has been open for the predetermined period of time. The apparatus also includes electrical circuit components responsive to the detecting components for generating the signal indicating that the door has been open for the predetermined period of time.

14 Claims, 2 Drawing Figures

DOOR STATUS DETECTOR APPARATUS

BACKGROUND OF THE INVENTION

1. Field of the Invention

This invention relates generally to apparatus for detecting when a door has not been closed and more particularly, but not by way of limitation, to apparatus for determining when a door has been left open for a predetermined period of time.

2. Description of the Prior Art

In various situations it is important to know whether a door has been closed within a certain amount of time. For example, in the restaurant industry and other food-handling businesses wherein the cold storage of meats and produce is imperative for food quality and health reasons, it is important that the door to the cold storage area be closed whenever someone is neither entering nor exiting therefrom. In many instances employees enter the storage area, such as a walk-in freezer, to obtain necessary food, but upon exiting the area they fail to properly close the door. Such neglect leads to wasteful energy consumption to overcome the loss of refrigeration through the open door and also leads to spoiled goods when adequate refrigeration cannot be maintained. Therefore, in these situations it is vital to provide a means for alerting those within the vicinity of the door that the door has not been closed after it has been left open for a predertermined period of time.

There have been certain proposals for devices which detect when a door, window, or the like has been initially opened. An example of this is a common burglar alarm. However, we do not believe that any such previous proposals disclose, either singly or in combination, the apparatus of the present invention which detects the non-closing of a door after it has remained open for a period of time.

SUMMARY OF THE INVENTION

The present invention overcomes the above-noted and other shortcomings of the previous proposals known to us by providing a novel, useful and improved door status detector apparatus. This apparatus detects when a door has not been closed after being open for a predetermined period of time by creating a signal indicating that the door has remained open for the predetermined amount of time.

The apparatus of the present invention includes means responsive to both the opening of the door and the closing of the door for monitoring the positional status of the door. The apparatus also includes means responsive to the monitoring means for detecting when the door has been open for the predetermined period of time and means responsive to the detecting means for generating the signal indicating that the door has been open for the predetermined period of time.

More particularly, the monitoring means includes a proximity switch having a magnetic element and a switch element responsive to the magnetic element.

The detecting means includes a timer for generating a pulse having a duration equal to the predetermined amount of time when the monitoring means responds to the opening of the door. The detecting means also includes means for determining when the predetermined pulse duration ends concurrently with the continued monitoring by the monitoring means of the door in an open positional status.

The generating means may include an audible signal device (e.g., a buzzer) or any other appropriate signal device (e.g., a strobe light).

From the foregoing, it is a general object of the present invention to provide a novel, useful and improved door status detector apparatus. Other and further objects, features and advantages of the present invention will be readily apparent to those skilled in the art upon a reading of the description of the preferred embodiment which follows when taken in conjunction with the accompanying drawings.

DETAILED DESCRIPTION OF THE PREFERRED EMBODIMENT OF THE INVENTION

Figure 1:
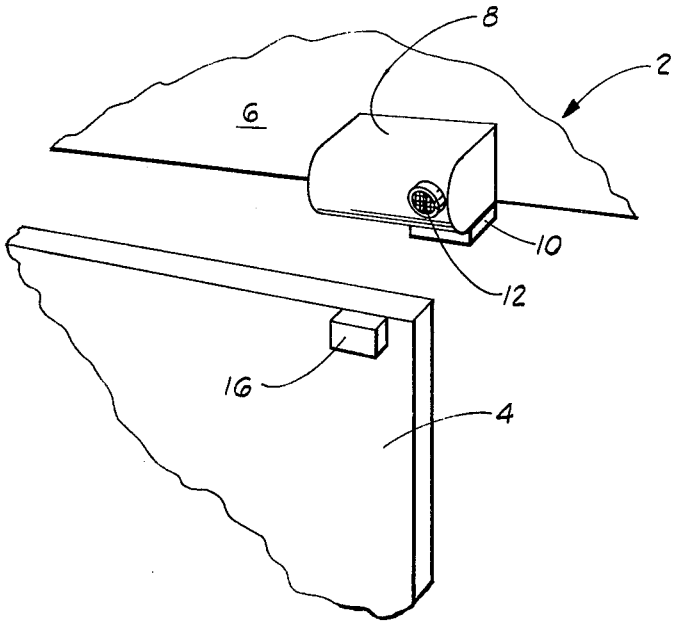
FIG. 1 is a perspective schematic illustration of the present invention as attached to a door and a door frame.

With reference now to the drawings, the preferred embodiment of the present invention will be described. FIG. 1 shows the apparatus of the present invention, generally referred to by the numeral 2, attached to an edge of a door 4 and to the structure 6 to which the door 4 is connected. More particularly, FIG. 1 indicates that the apparatus 2 includes a housing 8 to which is connected a switch element 10 of a proximity switch and to which is further connected a buzzer, or other appropriate audible signal source, 12. In addition to including the switch element 10, the proximity switch includes a magnetic element 16 which is the portion of the apparatus 2 connected to the door 4. The housing 8 is connected to the structure 6 and the magnetic element 16 is connected to the door 4 so that the switch element 10 and the magnetic element 16 are adjacently located when the door 4 is closed within the structure 6.

The switch element 10 and the magnetic element 16 of the proximity switch provide means responsive to the opening of the door 4 and the closing of the door 4 for monitoring the positional status of the door. That is, because the switch element 10 is responsive to the magnet contained within the magnetic element 16, the proximity switch monitors the open or closed positional status of the door 4 as the switch contact arm within the switch element 10 moves from a first position when the door is closed and the magnet is adjacent thereto to a second position when the door 4 is opened and the magnet is thereby moved away from the switch element. These two elements of the proximity switch control the activation of the electronic circuit which is contained within the housing 8 for establishing when the door has not been closed after a predetermined period of time.

Figure 2:
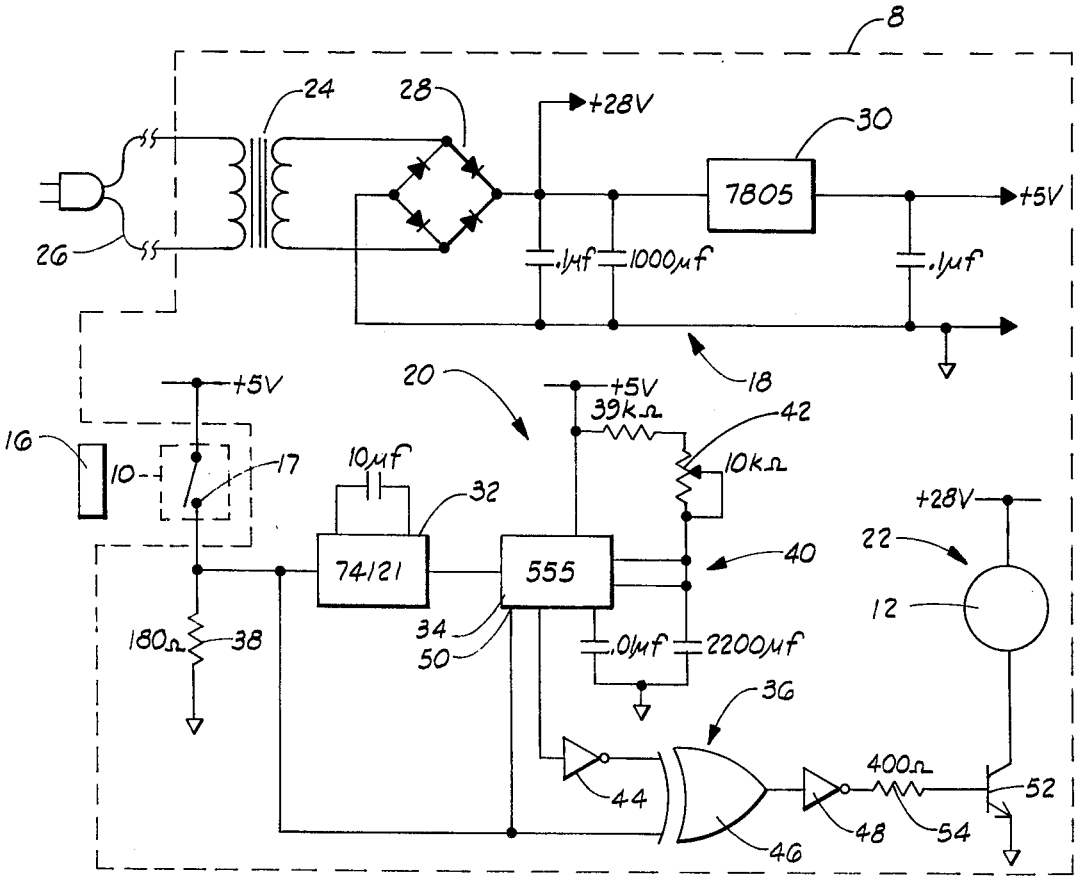
FIG. 2 is a schematic diagram of a preferred embodiment circuit of the present invention.

The preferred embodiment of this electronic circuit is shown in FIG. 2. FIG. 2 indicates that the apparatus 2 includes the previously mentioned means for monitoring the positional status of the door comprising the switch element 10 and the magnet element 16. FIG. 2 shows the switch contact arm of the switch element 10 in its previously mentioned first position. FIG. 2 also indicates that the apparatus includes the electronic circuit contained within the housing 8.

The electronic circuit includes a power circuit 18, means 20 responsive to the monitoring means for detecting when the door 4 has remained open for the predetermined period of time, and means 22 responsive to the detecting means 20 and the monitoring means for generating the signal indicating when the door has been open for the predetermined period of time. More particularly, the generating means is shown to include the buzzer, or other audible sound source, 12.

The power circuit 18 includes a transformer 24 having its primary winding connected to a main power supply via an electric line cord 26. The secondary winding of the transformer 24 is connected to a full-wave rectifier 28 which rectifies the alternating current from the transformer 24 to a substantially direct current. In the preferred embodiment shown in FIG. 2 this rectification establishes an approximately 28-volt potential above the system ground. Connected within the power circuit 18 are a plurality of capacitors as is known in the art. Also connected within the power circuit is a 5-volt regulator 30 which provides a substantially steady output of 5 volts in the preferred embodiment. This 5-volt output is appropriately distributed throughout the electronic circuit.

The means 20 for detecting when the door 4 has been open for the predetermined period of time includes a trigger device 32, a timer 34 for generating a pulse having a duration equal to the predetermined amount of time, and means 36 for determining when the predetermined pulse duration ends concurrently with the continued monitoring of the door in an open positional status by the monitoring means.

The trigger device 32 may be a monostable multivibrator such as is shown in FIG. 2. The device 32 has its activation input connected to system ground through a resistor 38 and to the 5volt potential through the switch element 10. The output of the device 32 is connected to the trigger input of the timer 34.

This connection to the trigger input of the timer 34 electrically associates the timer 34 with the switch element 10 for triggering, at the output of the timer 34, a pulse having a predetermined duration when the switch element 10 responds to the movement of the magnetic element 16 as the door is opened. In other words, as the door 4 is opened, the magnetic element 16 is moved so that the switch contact arm within the switch element 10 moves from its previously mentioned first postion to its second position. In the FIG. 2 embodiment this movement to the second position places the switch contact arm in contact with a terminal 17 of the switch element 10. This movement between the first and second positions of the switch element 10 triggers the device 32 which in turn triggers the timer 34 to generate the pulse having the predetermined duration.

To establish the predetermined duration of the pulse, the timer 34 includes a resistor-capacitor network 40 as is shown in FIG. 2 and is known by those having ordinary skill in the art. Included within the network 40 is an adjustable electrical component, such as the potentiometer 42, for variably predetermining the pulse duration. That is, as the potentiometer 42 is varied, so is the period of the pulse which is provided by the timer 34 in response to the monitoring means monitoring the opening of the door 4.

The pulse put out by the timer 34 is transmitted to the means 36 which determines when the predetermined pulse duration ends concurrently with the continued monitoring by the monitoring means of the door 4 in an open position. Thus, the means 36 is responsive to both the switch element 10 and the timer 34. In the preferred embodiment shown in FIG. 2 the determining means 36 includes a plurality of digital logic gates associated with the timer 34 and the switch element 10. In particular, the logic gates include a first inverter gate 44, an EXCLUSIVE OR gate 46, and a second inverter gate 48. The output of the timer 34 is connected to one input of the EXCLUSIVE OR gate 46 via the first inverter 44, and the terminal of the switch element 10 is directly connected to the other input of the EXCLUSIVE OR gate 46. Through the functioning of the EXCLUSIVE OR gate 46, the concurrent condition of the expiration of the door 4 can be determined.

In addition to containing the previously discussed elements, the detecting means 20 further includes means for terminating the timer pulse when the switch element 10 moves from its second position to its first position prior to the normal expiration of the predetermined duration of the pulse. This terminating means includes the connection extending between the contact terminal 17 of the switch element 10 and a reset input 50 of the timer 34.

The generating means 22, which is responsive to the detecting means 20 so that it generates a signal indicating that the door has been open for the predetermined period of time when the detecting means 20 detects the concurrent condition of the expiration of the predetermined pulse duration and the continued open position of the door 4, includes the audible signal source or buzzer 12 and a signal source activation means. The activation means comprises a transistor 52, which has its collector connected to the signal source and its emitter connected to the system ground, and a resistor 54, which is connected between the base of the transistor 52 and the output of the second inverter 48.

Having thus described the structural elements of the preferred embodiment of the apparatus of the present invention, the operation of the apparatus in creating an audible signal to indicate when the door 4, mounted in the door frame structure 6, has remained open for a predetermined period of time. This operation begins with an analysis of the proximity switch having the switch element 10 and the magnetic element 16 adjacently positioned when the door 4 is closed. This is the position schematically illustrated in FIG. 2 wherein a magnet within the magnetic element 16 attracts the switch arm of the switch element 10 away from the terminal 17. This open position of the switch contact arm is its first position in the FIG. 2 embodiment. It is to be noted that this is a normally open type of switch element 10; however, a normally closed type of switch element 10 could similarly be used with appropriate signal level conversion devices contained within the remainder of the circuit as is known by those having ordinary skill in the art.

With the switch element 10 in the position as shown in FIG. 2, the door status detector apparatus is deactivated because the proximity switch is indicating that the monitored door 4 is properly closed. However, when the door 4 is opened, the magnetic element 16 is moved away from the switch element 10 thereby decreasing the force of the magnetic field exerted on the switch contact arm by the magnet within the element 16 so that the switch contact arm closes against the terminal 17. This closure pulls the input of the device 32, the reset input 50 of the timer 34, and one input of the EXCLUSIVE OR gate 46 to the high logic level established by the 5-volt power bus. With the closure of the switch contact arm, it has now moved to its second position. This movement from the first position to the second position of the switch element 10 and the concomitant application of the high logic level signal to the input of the device 32 causes the device 32 to trigger the timer 34 whereby a pulse, having the duration as predetermined by the setting of the potentiometer 42 and the values of the other network 40 components, is triggered at the output of the timer 34 and transferred to the first inverter 44.

Throughout the duration of the pulse, the pulse is at a high logic level so that the signal into the outer input of the EXCLUSIVE OR gate 46 from the output of the inverter 44 is at a low logic level. Therefore, once the door 4 has been opened, the EXCLUSIVE OR gate 46 has a high logic level signal on one input (from the terminal 17) and a low logic level signal on the other input (from the inverter 44). Because of the functional nature of the EXCLUSIVE OR gate 46, this combination of signals causes a high logic level signal to be output therefrom for application to the input of the second inverter gate 48. This causes the output of the inverter gate 48 to be low to maintain the transistor 52 in an off condition. With the transistor 52 off, the buzzer 12 is deactivated so that no audible signal is generated. Thus it is apparent that the mere opening of the door 4 causes no alarm signal to be provided.

However, if the door 4 is maintained in an open position for a period concurrent with the duration of the pulse from the timer 34, then an alarm signal is generated upon the expiration of the predetermined duration of the pulse. This occurs because when the pulse expires, the output of the timer 34 goes to a low logic level which is inverted into a high logic level by the inverter 44 and applied to the respective input of the EXCLUSIVE OR gate 46. Thus, at this time, both inputs of the EXCLUSIVE OR gate are high (the other input is also high because the door 4 is still open and thus the switch contact arm of the switch element 10 is still in its second position). This double high logic level input causes a low logic level to be output from the gate 46 for inversion to a high logic level by the inverter 48. This high signal switches the transistor 52 on thereby connecting the buzzer 12 between the 28-volt potential and the system ground. This activates the buzzer 12 for alerting whomever is in the vicinity of the buzzer that the door has remained open for the predetermined period of time. Thus, the present apparatus provides the appropriate signal when the door 4 has not been closed as it should have been for such reasons as were previously exemplified regarding the restaurant and food processing industries.

To prevent false alarms and to permit the monitoring of repeated openings of the door during short periods of time, the present invention resets itself when the door has been opened and then closed within periods of time which are shorter than the predetermined duration of the pulse provided by the timer 34. This resetting occurs whenever the door is closed because upon closure of the door 4, the magnetic element 16 is again placed adjacent the switch element 10 thereby causing the switch contact arm to move from its closed second position to its open first position. This opening of the switch contact arm causes the input of the device 32, the reset input 50 of the timer 34 and the respective input of the EXCLUSIVE OR gate 46 to be pulled to the low logic level provided by the system ground. Pulling the reset input 50 of the timer 34 to this low logic level resets the timer by terminating the pulse prior to the normal expiration of the predetermined duration.

In conclusion it is to be noted that the particular integrated circuit device numbers and discrete component values shown in FIG. 2 are not to be considered as limiting the types of devices or values of components which may be used in any particular embodiment of the present invention. These device numbers and values are merely shown to disclose the present preferred embodiment of the present invention.

It is also to be noted that the proximity switch can be generally comprised of a first element, other than the magnetic element 16, mounted on the door and a second element, other than the mechanical switch element 10, mounted with the electronic circuit contained in the housing 8. For example, the first element could be an opto-electronic device and the second element could be an electronic switching circuit responsive to the opto-electronic device constituting the first element.

Thus the present invention of a door status detector apparatus is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A door status detector apparatus comprising:

a proximity switch responsive to the opening and closing of a door;

a timer having a trigger input electrically associated with said proximity switch for triggering, at the output of said timer, a pulse having a predetermined duration when said proximity switch responds to the opening of the door, means responsive to said proximity switch and said timer for determining the concurrent condition of the expiration of the predetermined pulse duration and the continued open position of the door; and means responsive to said condition determining means for generating a signal when the concurrent condition is determined to exist.

2. Apparatus as recited in claim 1, wherein said proximity switch includes:

a first element mounted on the door; and a second element, responsive to said first element as the door is opened or closed, mounted on the structure to which the door is mounted.

3. An apparatus as recited in claim 1, wherein said timer includes an adjustable electrical component for variably predetermining the pulse duration.

4. An apparatus as recited in claim 1, wherein said determining means includes digital logic gates associated with said timer and said proximity switch.

5. An apparatus for creating an audible signal to indicate when a door mounted in a door frame has been open for a predetermined period of time, said apparatus comprising:

a proximity switch including:

a magnet mounted along one edge of the door; and a switch mounted along the door frame adjacent said magnet when the door is closed, said switch being in a first position when the door is closed and in a second position when the door is open;

a timer electrically associated with said switch for providing a pulse having a predetermined duration when said switch moves from its first position to its second position;

means for determining when the predetermined pulse duration expires concurrently with said switch being in its second position; and means responsive to said determining means for generating the audible signal.

6. An apparatus as recited in claim 5, further comprising means for terminating the timer pulse when said switch moves from its second position to its first position prior to the expiration of the predetermined duration of the pulse.

7. An apparatus as recited in claim 6, wherein said determining means includes digital logic gates associated with said timer and said switch.

8. An apparatus as recited in claim 7, wherein said digital logic gates includes an EXCLUSIVE OR gate having respective inputs associated with said timer and said switch.

9. An apparatus as recited in claim 7, wherein said timer includes an adjustable electrical component for variably predetermining the pulse duration.

10. An apparatus for creating a signal indicating when a door has remained open for a predetermined amount of time, said apparatus comprising:

monitoring means, responsive to the opening of the door and the closing of the door, for monitoring the positional status of the door;

detecting means, responsive to said monitoring means, for detecting when the door has been open for the predetermined period of time, said detecting means including:

a timer for generating a pulse, having a duration equal to the predetermined amount of time, when said monitoring means responds to the opening of the door; and determining means for determining when the predetermined pulse duration ends concurrently with the continued monitoring by said monitoring means of the door in an open positional status; and generating means, responsive to said detecting means, for generating the signal indicating when the door has been open for the predetermined period of time.

11. An apparatus as recited in claim 10, wherein:

said monitoring means includes a proximity switch having:

a magnetic element; and a switch element responsive to said magnetic element;

said timer includes a reset input for terminating the pulse prior to the predetermined amount of time, said reset input being electrically connected to a terminal of said switch element; and said determining means includes an EXCLUSIVE OR logic gate having a first input for receiving an inverted logic level of the pulse generated by said timer and having a second input electrically connected to the terminal of said switch element to which said reset input of said timer is connected so that said EXCLUSIVE OR logic gate provides an output signal for indicating the concurrence of the end of the duration of the pulse and the continued monitoring by said monitoring means of the door in an open positional status.

12. An apparatus as recited in claim 1 wherein:

said timer includes a reset input for receiving a signal to terminate the pulse prior to the expiration of the predetermined duration, said reset input being electrically connected to a terminal of said proximity switch; and said determining means includes an EXCLUSIVE OR logic gate having a first input for receiving an inverted logic level of the output pulse of said timer and having a second input electrically connected to the terminal of said proximity switch to which said reset input of said timer is electrically connected.

13. An apparatus as defined in claim 5, wherein:

said timer includes a reset input for receiving a signal to terminate the pulse prior to the expiration of the predetermined duration, said reset input being electrically connected to a terminal of said proximity switch; and said determining means includes an EXCLUSIVE OR logic gate having a first input for receiving an inverted logic level of the output pulse of said timer and having a second input electrically connected to the terminal of said proximity switch to which said reset input of said timer is electrically connected.

14. An apparatus for creating an audible signal to indicate when a door mounted in a door frame has been opened for a predetermined period of time, said apparatus comprising:

a proximity switch including:

a magnet mounted along one edge of the door; and a switch mounted along the door frame so that said switch is adjacent said magnet when the door is closed, said switch being in a first position when the door is closed and in a second position when the door is open;

a monostable multivibrator having a trigger input electrically connected to a terminal of said switch and having an output for providing a triggering pulse;

an integrated circuit timer including:

an input electrically connected to the output of said monostable multivibrator;

a reset input electrically connected to the terminal of said switch to which said monostable multivibrator input is connected;

pulse duration setting inputs electrically connected to an adjustable electrical component for variably predetermining the pulse duration; and an output for providing a pulse, having a variably predetermined maximum duration, when said switch moves from said first position to said second position;

an EXCLUSIVE OR logic gate having a first input for receiving an inverted logic level of the pulse provided from the output of said timer and having a second input electrically connected to the terminal of said switch to which the input of the monostable multivibrator and the reset input of the timer are connected so that said EXCLUSIVE OR logic gate provides an actuating signal when the pulse from said timer expires concurrently with said switch remaining in said second position; and audible signaling means, responsive to said EXCLUSIVE OR logic gate, for generating the audible signal.

* * * * *